United States Patent [19]

Richards

[11] 4,452,489

[45] Jun. 5, 1984

[54] MULTIPLE LEVEL METHANE DRAINAGE SHAFT METHOD

[75] Inventor: Walter L. Richards, Huntington Beach, Calif.

[73] Assignee: Methane Drainage Ventures, Placentia, Calif.

[21] Appl. No.: 420,149

[22] Filed: Sep. 20, 1982

[51] Int. Cl.[3] ..... E21C 41/10; E21B 43/30

[52] U.S. Cl. ..... 299/2; 166/50; 299/12; 299/19

[58] Field of Search ..... 299/2, 12, 19; 166/50

[56] References Cited

U.S. PATENT DOCUMENTS

| | | | |
|---|---|---|---|
| 922,603 | 5/1909 | Laws | 98/50 |
| 925,274 | 6/1909 | Belloni | 98/50 |
| 942,950 | 12/1909 | Ward | 98/50 |
| 963,787 | 7/1910 | Martin | 98/50 |
| 1,660,187 | 2/1928 | Ehrat | 299/2 |
| 1,867,758 | 7/1932 | Ranney | 299/2 |
| 2,508,949 | 5/1950 | Howard | 299/2 |
| 3,582,138 | 6/1971 | Loofbourow et al. | 299/19 X |
| 3,814,480 | 6/1974 | Dahl et al. | 299/2 |
| 3,934,649 | 1/1976 | Pasini et al. | 299/12 X |
| 4,026,355 | 6/1975 | Johnson et al. | 166/246 |
| 4,072,351 | 7/1978 | Roye | 299/19 X |
| 4,089,374 | 5/1978 | Terry | 166/259 |
| 4,195,886 | 4/1980 | Roye | 299/12 |
| 4,245,699 | 1/1981 | Steeman | 166/271 |
| 4,303,274 | 12/1981 | Thakur | 299/12 |

OTHER PUBLICATIONS

H. H. Fields, et al., "Degasification and Production of Natural Gas from an Air Shaft in the Pittsburgh Coalbed"; U.S. Bureau of Mines; 1976.

*Primary Examiner*—Ernest R. Purser

*Attorney, Agent, or Firm*—Fowler, Lambert & Hackler

[57] ABSTRACT

A method for collecting methane gas from subterranean formations having a plurality of spaced-apart coal seams containing methane gas includes the steps of drilling at least one shaft from the earth's surface to a depth sufficient to intersect a plurality of seams containing gas to be collected, excavating a working area at selected seams with each of the working areas communicating with the shaft, and drilling a plurality of boreholes from each of the working areas into the seams and collecting methane gas from the boreholes.

15 Claims, 2 Drawing Figures

MULTIPLE LEVEL METHANE DRAINAGE SHAFT METHOD

The present invention is generally related to the collection of gas from subterranean formations, and more particularly is directed to a method for collecting gas from subterranean formations having a plurality of spaced apart seams containing the gas.

Many subterranean formations may contain gas. As an example, coal seams, or deposits, generally include a significant amount of methane gas which escapes therefrom as the coal is mined, thereby causing hazardous conditions in underground mining operations. Previous attempts to remove methane from underground coal seams has been primarily directed to removal of such gas in order to provide a safe working environment for the mining of coal.

A number of methods are employed to reduce the methane level in working mines. These methods include air dilution systems to provide sufficient air within the mines to reduce the methane level below 1% to prevent a combustive mixture from forming, drilling of vertical shafts from the earth's surface to intersect the seams in advance of mining, and the drilling of holes within the coal seams in advance of mining either from the earth's surface or from an adjacent coal seam. As an example of these methods see U.S. Pat. No. 3,934,649 to Pasini et. al. entitled "Method For Removal of Methane From Coalbeds" and U.S. Pat. No. 4,303,274 to Thakur entitled "Degasification of Coal Seams".

Heretofore, there has been no system or method for the recovery of methane gas from underground, or subterranean, formations irrespective of later mining of the seams for their coal content. The present invention is directed toward a gas drainage system, such as for methane, for collecting such gas from low pressure reservoirs, such as virgin coal seams, through the use of horizontal boreholes completed from a multiplicity of levels. The method is also suitable for removal of methane gas from coal seams having thicknesses less than that required for commercial mining of coal from the coal seam.

SUMMARY OF THE INVENTION

In accordance with the present invention a method for collecting gas from subterranean formations having a plurality of spaced apart seams containing subterranean gas includes the steps of drilling as least one shaft from the earth's surface to a depth sufficient to intersect a plurality of seams containing gas to be collected, excavating a working area at selected seams with each of said working areas communicating with the shaft, drilling a plurality of boreholes from each of said working areas into the seams and collecting gas from the boreholes and conducting the gas through the working areas and through the shaft to the earth's surface.

More particularly, the method of the present invention may be utilized for collecting methane gas from subterranean coal seams containing the methane gas and enables the collection of methane gas from coal seams having a thickness of less than approximately three feet.

The method may include drilling of two spaced apart shafts from the earth's surface which intersect a plurality of coal seams and thereafter excavating a generally toroidal-shaped working area within a plurality of the coal seams intersected by the two shafts with each of the working areas communicating with the two shafts.

A plurality of boreholes may be drilled from each of said toroidal-shaped working areas into the coal seams with the bore hole being drilled within the coal seams in an outwardly direction from the toroidal-shaped working areas.

The method of the present invention may also include the insertion of a liner in each of the boreholes and connecting the liners to a conduit system within the toroidal-shaped working areas and through one of the two shafts to the earth's surface, passing air through another of the two shafts and circulating the air through the toroidal-shaped working areas and exhausting the air through one of the two air shafts.

BRIEF DESCRIPTION OF THE DRAWINGS

The advantages and features of the present invention will appear from the following description considered in conjunction with the accompanying drawings in which.

DETAILED DESCRIPTION

Figure 1:
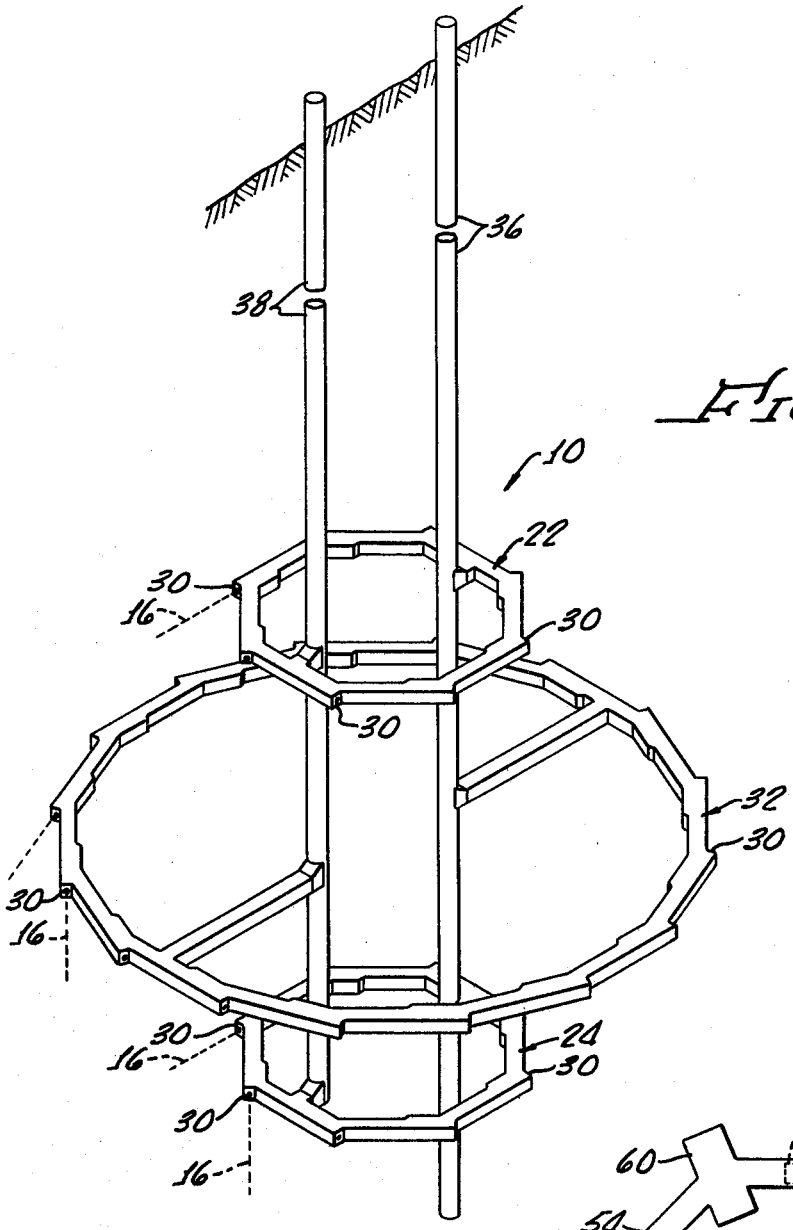
FIG. 1 is a perspective view of a methane drainage system in accordance with the method of the present invention generally showing two shafts drilled from the earth's surface and intersecting three spaced apart coal seams. Also shown are workings at each of the three coal seam levels which include a generally toroidal-shaped working area at each of the coal seam levels and a plurality of boreholes (dashed lines) drilled within the coal seams and outwardly from the toroidal-shaped working areas; and, FIG. 2 shows a cross sectional view of an alternative working area in one of a plurality of coal seams in accordance with the present invention utilizing a single shaft from the earth's surface and a plurality of drill sites around a toroidal shaped working area for drilling boreholes into the coal seam in generally by radial directions from the toroidal-shaped working area.

Turning now to FIG. 1 there is shown a mining system 10 in accordance with the method of the present invention for removing and collecting methane gas from low pressure reservoirs such as virgin coal seams utilizing a plurality of horizontal boreholes 16 completed from a plurality of spaced apart coal seams.

It has been shown that long horizontal holes are more efficient in draining methane gas from coal seams than vertical holes drilled from the earth's surface. It is to be understood that "horizontal" holes, within the meaning of the present description, means holes that are drilled within the coal seam in a longitudinal manner generally between the top and the bottom of the coal seam as opposed to "vertical" which describes holes drilled in a fashion to intersect the seams. Hence it can be appreciated that horizontal holes expose more of the coal seam to a conduit system, namely the borehole for collecting a low pressure methane gas from the coal seam.

In order to access a large amount of methane from underground coal seams, the method of the present invention utilizes the simultaneous draining of methane gas from more than one level, that is from more than one of a plurality of spaced apart subterranean coal seams.

Turning again to FIG. 1 the methane drainage system 10 as shown is completed in three separate levels from methane drainage. It is to be appreciated that any number of levels may be utilized depending upon the number of coal seams present, the thickness of the coal seam, and the amount of methane contained therein as may be determined by sampling techniques. Three levels are shown in FIG. 1 as being typical of a methane drainage system in accordance with the method of the present invention.

As shown in the figure an upper and a lower level 22, 24 have been constructed to provide for eight well sites, 30, and a middle level 32 is shown for providing sixteen well sites.

This system can utilize a skip shaft 36 which provides for access of personnel, equipment and an intake for fresh air. A return air shaft 38 is provided for the exhaust of return air and also the methane production which is carried in a separate enclosed production pipeline (not shown).

The workings at the upper, middle and lower levels 22, 32, 24 from which the boreholes 16 are drilled may be generally toroidal-shaped in order to provide a good ventilation pattern of fresh air to all the drilling sites. In addition, this arrangement enables a large exposure of coal face area for drilling without the incidence of obstacles.

The shafts 36, 38 as well as the working at the levels 22, 32, 24 are excavated in accordance with well known principles and spaced apart in order to avoid rock mechanics problems. Horizontal boreholes 16 are drilled from each well site 30 in a radial manner and generally horizontally and generally contained in the coal seam at each of the levels being worked. These horizontal boreholes may be drilled in any manner well known in the art and when completed each hole provides a pie-shaped sector of production from a virgin block of coal reservoir for methane gas.

Alternatively, boreholes may be drilled from a working area into overlaying or underlaying coal seams without excavating a working area at each coal seam from which gas is to be collected. Factors relating to whether boreholes are drilled in this manner include distance between the seams, the thickness of the seams as well as rock mechanics considerations.

It should be appreciated that the working, or entry chamber system at each level 22, 32, 24 as shown in FIG. 1 are constructed to avoid rock stability problems. The well sites 30, or drill chambers, are just wide enough to provide access for drilling and not too wide to produce rock mechanic problems. These well sites may be also located remotely from the shaft to avoid rock mechanics roof support problems adjacent to the shafts.

In order to provide fresh air for drilling, the drilling procedure is to work from the most remote area from the intake shaft 36 back to the intake shaft to thereby enable all drilling to progress in fresh air.

Figure 2:
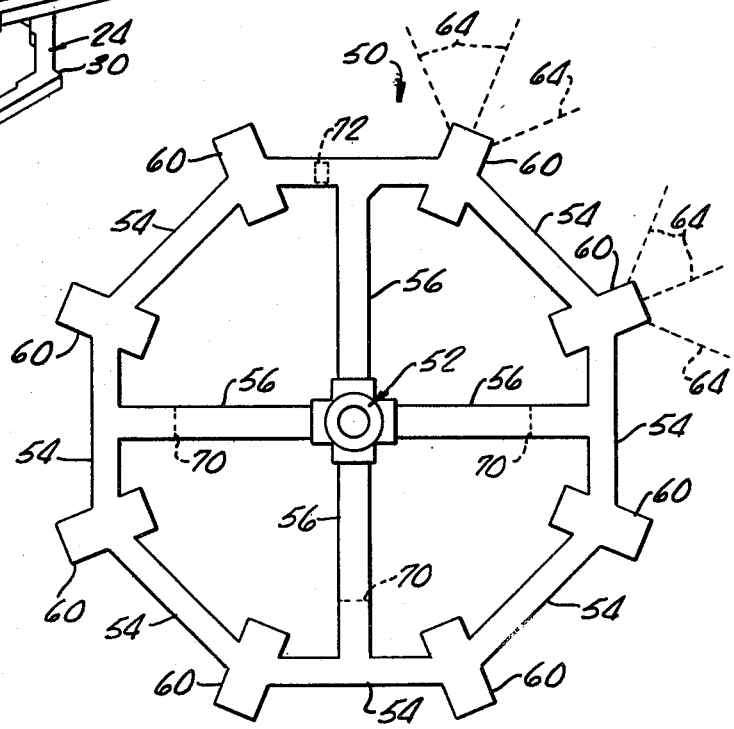

An alternate mining system 50 in accordance with the present invention is shown in FIG. 2. This system 50 utilizes a single shaft 52 which intersects a plurality of coal seams (not shown in FIG. 2) and at each level to be worked a generally toroidal-shaped working area 54 is excavated which communicates with the shaft 52 by means of radial quarters 56. Eight drill sites 60 may be provided along the toroidal working area 54 for the drilling of horizontal boreholes 64 therefrom. Airflow is introduced through the shaft 52 and regulated within each of the working areas by air regulators 70 disposed in each of the quarters 56. The exhaust air is removed from the working area by fan 72 communicating with an exhaust duct (not shown) to the earth's surface.

It is to be appreciated that any number of mining systems may be constructed in accordance with the method of the present invention and, although there has been described a specific system and method for collecting gas from subterranean formations in accordance with the present invention for the purpose of illustrating the manner in which the invention may be used to advantage, it should be appreciated that the invention is not limited thereto. Accordingly, any and all modifications, variations or equivalent methods which may occur to those skilled in the art should be considered to be within the scope of the invention as defined by the appended claims.

What is claimed is:

1. A method for collecting gas from subterranean formations having a plurality of spaced apart seams containing said gas, said method comprising the steps of:

drilling at least one shaft from the earth's surface to a depth surfficient to intersect a plurality of seams containing gas to be collected;

excavating a working area at selected seams with each said working area communicating with said shaft, and said selected seams;

drilling a plurality of boreholes from each of said working areas into the seams; and collecting gas from said boreholes and conducting said gas through said working areas and through said shaft to the earth's surface.

2. A method for collecting gas from subterranean formations having a plurality of spaced apart seams containing said gas, said method comprising the steps of:

drilling at least one shaft from the earth's surface to a depth sufficient to intersect a plurality of seams containing gas to be collected;

excavating a working area at each seam from which gas is to be collected, each said working area communicating with said shaft;

drilling a plurality of generally horizontal boreholes from each of said working areas into the seams containing said working areas, said generally horizontal boreholes being drilled outwardly from said working areas in a spaced apart relationship; and collecting gas from said boreholes and conducting said gas through said working areas and through said shaft to the earth's surface.

3. A method for collecting gas from subterranean formations having a plurality of spaced apart seams containing said gas, said method comprising the steps of:

drilling at least one shaft from the earth's surface to a depth sufficient to intersect a plurality of seams containing gas to be collected;

excavating a working area at each seam from which gas is to be collected, each said working area communicating with said shaft;

excavating a plurality of drill sites within said working area, said drill sites being remote from said shaft;

drilling a plurality of generally horizontal boreholes from each of said drill sites into the seams containing said working areas, said generally horizontal boreholes being drilled outwardly from said drill sites in a spaced apart relationship; and, collecting gas from said boreholes and conducting said gas through said working areas and through said shaft to the earth's surface.

4. A method for collecting gas from subterranean formations having a plurality of spaced apart seams containing said gas, said method comprising the steps of:

drilling at least one shaft from the earth's surface to a depth sufficient to intersect a plurality of seams containing gas to be collected;

excavating a generally toroidal-shaped working area at each seam from which gas is to be collected, each said toroidal-shaped working area communicating with said shaft;

drilling a plurality of boreholes from each of said toroidal-shaped working areas into the seams containing said toroidal-shaped working areas, said boreholes being drilled within said seams in outwardly directions from the toroidal-shaped working areas; and collecting gas from said boreholes and conducting said gas through said toroidal-shaped working areas and through said shaft to the earth's surface.

5. A method for collecting gas from subterranean formations having a plurality of spaced apart seams containing said gas, said method comprising the steps of:

drilling at least one shaft from the earth's surface to a depth sufficient to intersect a plurality of seams containing gas to be collected;

excavating a generally toroidal shaped working area at each seam from which gas is to be collected, each said toroidal shaped working area communicating with said shaft;

excavating a plurality of drill sites within said toroidal shaped working area, said drill sites being remote from said shaft;

drilling a plurality of boreholes from each of said drill sites into the seams containing said toroidal shaped working areas, said boreholes being drilled within said seams in outwardly directions from the toroidal shaped working areas and drill sites; and, collecting gas from said boreholes and conducting said gas through said toroidal shaped working areas and through said shaft to the earth's surface.

6. The method of claim 1, 2, 3, 4, or 5 wherein at least one of the seams from which gas is to be collected has a thickness of less than about three feet.

7. The method of claim 5 further comprising the step of inserting a liner in each of the boreholes and connecting said liners to a conduct system within the working areas and shaft for transferring said gas to the earth's surface.

8. A method for collecting gas from subterranean formations having a plurality of spaced apart seams containing said gas, said method comprising the steps of:

drilling at least one shaft from the earth's surface to a depth sufficient to intersect a plurality of seams containing gas to be collected;

excavating a generally toroidal-shaped working area at each seam from which gas is to be collected, each said toroidal shaped working area communicating with said shaft;

drilling a plurality of boreholes from each of said toroidal shaped working areas into the seams containing said generally toroidal shaped working areas, said boreholes being drilled within said seams in directions generally tangential to the toroidal-shaped working areas, and outwardly therefrom; and collecting gas from said boreholes and conducting said gas through said toroidal-shaped working areas and through said shaft to the earth's surface.

9. A method for collecting gas from subterranean formations having a plurality of spaced-apart seams containing said gas, said method comprising the steps of:

drilling two spaced apart shafts from the earth's surface to a depth sufficient to intersect a plurality of seams containing gas to be collected;

excavating a generally toroidal-shaped working area at each seam from which gas is to be collected, each said toroidal-shaped working area communicating with the two shafts;

drilling a plurality of boreholes from each of said toroidal-shaped working areas into the seams containing said toroidal-shaped working areas, said boreholes being drilled within said seams in outwardly directions from the totoidal-shaped working areas; and collecting gas from said boreholes and conducting said gas through said toroidal-shaped working areas and through one of said two shafts to the earth's surface.

10. The method of claim 9 further comprising the step of inserting a liner in each of the boreholes and connecting said liners to a conduit system within the toroidal working areas and said one of the two shafts for transferring said gas to the earth's surface.

11. The method of claim 10 further comprising the steps of passing air down through another of the two shafts, circulating the air through the toroidal working areas and exhausting the air through said one of the two air shafts.

12. A method for collecting gas from subterranean formations having a plurality of spaced apart seams containing said gas, said method comprising the steps of:

drilling at least one shaft from the earth's surface to a depth sufficient to intersect a plurality of seams containing gas to be collected;

excavating a working area within a plurality of the seams intersected by said shaft, each said working area communicating with said shaft;

drilling a plurality of boreholes from each of said working areas into the seams containing said gas, said boreholes being drilled outwardly from said working areas in a spaced-apart relationship; and, collecting gas from said boreholes and conducting said gas through said working areas and through said shaft to the earth's surface.

13. A method for collecting gas from subterranean formations having a plurality of spaced apart seams containing said gas, said method comprising the steps of:

drilling at least one shaft from the earth's surface to a depth sufficient to intersect a plurality of seams containing gas to be collected;

excavating a working area within a plurality of the seams intersected by said shaft, each said working area communicating with said shaft;

drilling a plurality of generally horizontal boreholes from each of said working areas into the seams containing said working areas, said generally horizontal boreholes being drilled outwardly from said working areas in a spaced-apart relationship; and, collecting gas from said boreholes and conducting said gas through said working areas and through said shaft to the earth's surface.

14. A method for collecting methane gas from subterranean formations having a plurality of spaced-apart coal seams containing said methane gas, said method comprising the steps of:

drilling two spaced apart shafts from the earth's surface to a depth sufficient to intersect a plurality of coal seams containing methane gas to be collected;

excavating a generally toroidal-shaped working area within a plurality of the coal seams intersected by the two shafts, each said working area communicating with the two shafts;

excavating a plurality of drill sites within said toroidal-shaped working area, said drill sites being remote from both said spaced apart shafts;

drilling a plurality of boreholes from each of said drill sites into the coal seams containing said toroidal-shaped working areas, said boreholes being drilled within said coal seams in outwardly directions from the toroidal-shaped working areas and drill sites;

inserting a liner in each of the boreholes and connecting said liners to a conduit system within the toroidal-shaped working areas and through one of said two shafts to the earth's surface;

passing air through another of the two shafts, circulating the air through the toroidal shaped working areas and exhausting air through said one of the two air shafts; and, collecting methane gas from said boreholes and conducting said methane gas through said toroidal-shaped working areas and through said one of the two shafts to the earth's surface.

15. A method for collecting methane gas from subterranean formations having a plurality of spaced apart coal seams containing said methane gas, said coal seams having a thickness of less than three feet, said method comprising the steps of:

drilling at least one shaft from the earth's surface to a depth sufficient to intersect a plurality of seams containing gas to be collected;

excavating a working area at each seam from which gas is to be collected, each said working area communicating with said shaft;

drilling a plurality of generally horizontal boreholes from each of said working areas into the seams containing said working areas, said generally horizontal boreholes being drilled outwardly from said working areas in a spaced apart relationship; and, collecting gas from said boreholes and conducting said gas through said working areas and through said shaft to the earth's surface.

* * * * *